United States Patent [19]

Burdette

[11] 4,397,546

[45] Aug. 9, 1983

[54] PARTICLE DISPENSING SYSTEM

[75] Inventor: Lowrie W. Burdette, Rochester, N.Y.

[73] Assignee: Xerox Corporation, Stamford, Conn.

[21] Appl. No.: 340,131

[22] Filed: Jan. 18, 1982

[51] Int. Cl.[3] ..... G03G 15/08

[52] U.S. Cl. ..... 355/3 DD; 355/14 D; 118/653; 118/657

[58] Field of Search ..... 355/3 DD, 14 D; 118/651, 652, 636, 653, 657; 200/61.21, 84 C; 222/DIG. 1, 23, 232

[56] References Cited

U.S. PATENT DOCUMENTS 3,659,556 5/1972 Mutschler ..... 118/636 X 3,981,272 9/1976 Smith et al. ..... 355/3 DD X 3,998,537 12/1976 Smith et al. ..... 355/3 DD

FOREIGN PATENT DOCUMENTS 50-29145 7/1973 Japan .

*Primary Examiner*—A. C. Prescott

*Attorney, Agent, or Firm*—H. Fleischer; J. E. Beck; R. Zibelli

[57] ABSTRACT

An apparatus which discharges particles into the chamber of a housing storing a supply of developer material therein. Particles are dispensed from a storage container substantially uniformly to a region located therebeneath in the chamber of the housing and to a region displaced therefrom.

6 Claims, 3 Drawing Figures

PARTICLE DISPENSING SYSTEM

This invention relates generally to an electrophotographic printing machine, and more particularly concerns a development apparatus having an improved particle dispensing system for use therein.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a toner powder image on the photoconductive member which is subsequently transferred to a copy sheet. Finally, the powder image is heated to permanently affix it to the copy sheet in image configuration.

A suitable developer material generally comprises carrier granules having toner particles adhering triboelectrically thereto. This two-component mixture is brought into contact with the electrostatic latent image recorded on the photoconductive surface. A portion of the toner particles are attracted from the carrier granules to the latent image. These toner particles adhere to the latent image so as to form a powder image on the photoconductive surface.

Various methods have been devised for applying developer material to the latent image. For example, the developer material may be cascaded over the latent image with the toner particles being attracted from the carrier granules thereto. Other techniques utilize magnetic field producing devices which form brush-like tufts extending outwardly therefrom into contact with the photoconductive surface. In any event, it is evident that during the development process, toner particles are depleted from the developer material. Thus, additional toner particles must be furnished to the developer material so as to maintain copy density at a substantially optimum level. Typically, a supply of toner particles is stored in a hopper and periodically or continuously dispensed therefrom into the developer material. Numerous approaches have been devised for dispensing toner particles into the developer material. The following disclosures appear to be relevant:

U.S. Pat. No. 3,659,556
Patentee: Mutschler
Issued: May 2, 1972
U.S. Pat. No. 4,142,655
Patentee: Fantuzzo
Issued: March 6, 1979
Japanese Laid-Open No. 50-29145
Applicant: Canon, Inc.
Application Date: July 11, 1973
IBM Technical Disclosure Bulletin
Vol. 15, No. 4, September 1972
Page 1262
By: Queener
Co-pending U.S. Ser. No. 104,225, now U.S. Pat. No. 4,305,529
Applicant: Spehrley, Jr.
Filed: December 17, 1979
Co-pending U.S. Ser. No. 288,586
Applicant: Hoffman, Jr.

-continued

Filed: July 30, 1981

The relevant portions of the foregoing disclosures may be briefly summarized as follows:

Mutschler describes a development system in which toner particles are dispensed into a developer mixture. An auger drive system transports the developer mixture to a donor roll.

Fantuzzo discloses a pair of flexible augers for transporting toner particles from a remote container to a toner dispenser positioned adjacent the development system.

The Japanese publication describes a toner container having a rotary driven vaned member located in the opening thereof for dispensing particles into a supply passage. A screw conveyor moves the toner particles to the developing unit.

Queener discloses a flexible auger for transporting toner particles from a first station to a second station located within an office copying machine.

Spehrley, Jr. discloses a toner particle dispenser having a hopper storing a supply of toner particles therein. An auger is coupled to the hopper for receiving the toner particles and uniformly dispensing them into the sump of a housing having a developer material therein.

Hoffman, Jr. describes a toner particle dispenser having an auger coupled to a hopper storing toner particles therein. The auger includes a helical member disposed interiorly of a tubular member having a plurality of apertures therein. Fibers contact the moving toner particles to induce relative movement between the toner particles and helical member in a direction substantially normal to the direction of translation thereof. The fibers apply force on the toner particles which prevent particle clogging during the discharge thereof through the apertures in the tubular member.

In accordance with one aspect of the features of the present invention, there is provided an apparatus for discharging particles into the chamber of the housing storing a supply of developer material therein. The apparatus includes means for storing a supply of particles therein. Means are provided for dispensing particles substantially uniformly to a region located immediately beneath the storing means in the chamber of the housing. Means transport particles from the storing means to a region displaced therefrom and for discharging particles thereat into the chamber of the housing.

Pursuant to another aspect of the features of the present invention, there is provided an apparatus for developing an electrostatic latent image recorded on a photoconductive member used in an electrophotographic printing machine. The apparatus includes a housing defining a chamber for storing a supply of developer material comprising carrier granules and toner particles. Means, disposed in the chamber of the housing, advance the developer material into contact with the electrostatic latent image so that a portion of the toner particles are attracted from the carrier granules to the electrostatic latent image forming a toner powder image on the photoconductive member. Means store a supply of toner particles therein. Means are provided for dispensing toner particles substantially uniformly to a region located immediately beneath the storing means in the chamber of the housing. Means transport particles from the storing means to a region displaced therefrom and discharge particles thereat into the chamber of the housing.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
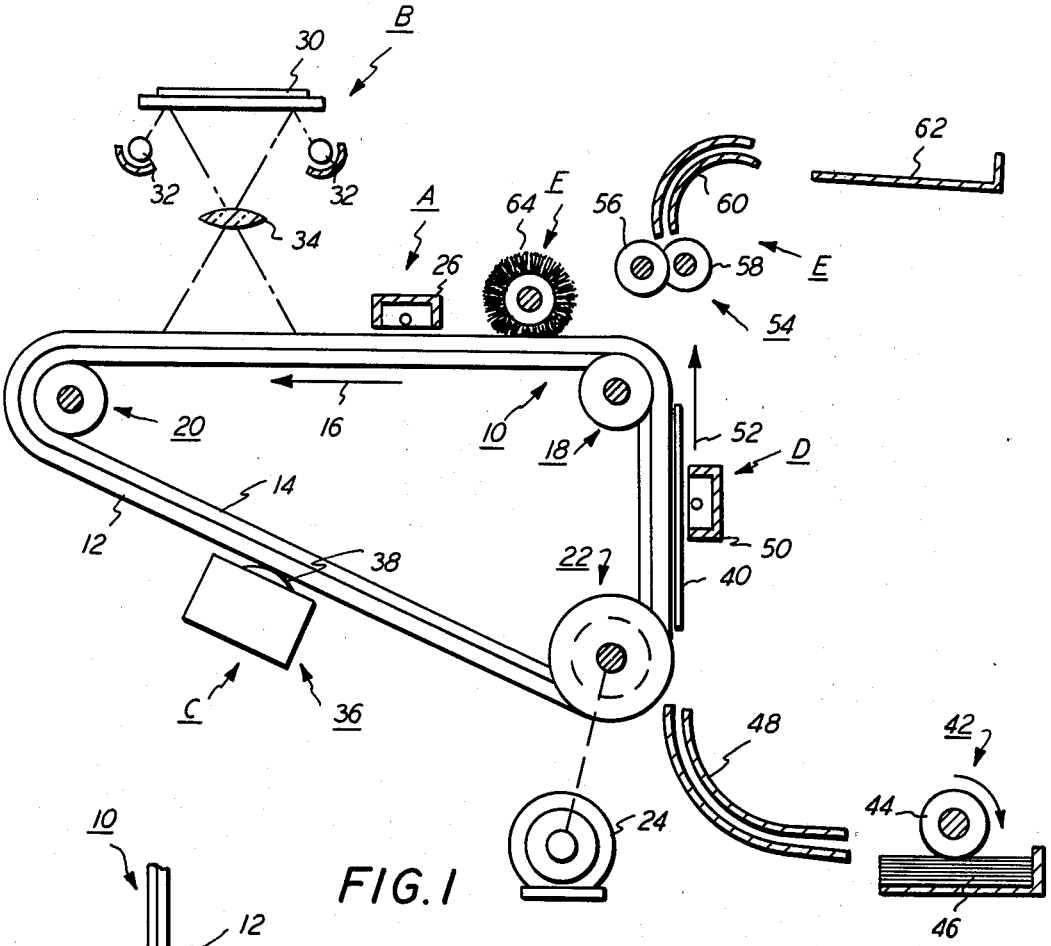
FIG. 1 is a schematic elevational view showing an illustrative electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various elements of the illustrative electrophotographic printing machine incorporating the particle discharging apparatus of the present invention therein. It will become evident from the following discussion that this apparatus is equally well suited for use in a wide variety of electrostatographic printing machines or other types of devices wherein granular particles are being transported and have to be dispensed in a substantially uniform manner. The apparatus of the present invention is not necessarily limited in its application to the particular embodiment depicted herein.

Inasmuch as the art of electrophotographic printing is well know, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by a suitable means such as a drive belt. Drive roller 22 includes a pair of opposed spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripper roller 18 and tension roller 20 are mounted rotatably. These rollers are idlers which rotate freely as belt 10 moves in the directly of arrow 16.

With the continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned facedown upon a transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28 disposed upon transparent platen 30. Thereafter, belt 10 advances the electrostatic latent image recorded on photoconductive surface 12 to development station C.

At development station C, a magnetic brush development system, indicated generally by the reference numeral 36, transports a developer material of carrier granules and toner particles into contact with the electrostatic latent image recorded on photoconductive surface 12. Magnetic brush development system 36 includes a magnetic brush developer roller 38. Magnetic brush developer roller 38 forms a brush of carrier granules and toner particles. The toner particles are attracted from the carrier granules to the electrostatic latent image forming a toner powder image on photoconductive surface 12 of belt 10. The detailed structure of magnetic brush development system 36 will be described hereinafter with reference to FIG. 2.

After development, belt 10 advances the toner powder image to transfer station D. At transfer station D, a sheet of support material 40 is moved into contact with the toner powder image. The sheet of support material is advanced to transfer station D by a sheet feeding apparatus, indicated generally by the reference numeral 42. Preferably, sheet feeding apparatus 42 includes a feed roller 44 contacting the uppermost sheet of a stack of sheets 46. Feed roller 44 rotates to advance the uppermost sheet from stack 46 into chute 48. Chute 48 directs the advancing sheet of support material into contact with the photoconductive surface 12 of belt 10 in a timed sequence so that the toner powder image developed thereon contacts the advancing sheet of support material at transfer station D.

Transfer station D includes a corona generating device 50 which sprays ions onto the backside of sheet 40. This attracts the toner powder image from photoconductive surface 12 to sheet 40. After transfer, the sheet continues to move in the direction of arrow 52 onto a conveyor (not shown) which advances the sheet to fusing station E.

Fusing station E includes a fuser assembly indicated generally by the reference numeral 54 which permanently affixes the transferred toner powder image to sheet 40. Preferably, fuser assembly 54 includes a heated fuser roll 56 and back-up roll 58. Sheet 40 passes between fuser roller 56 and back-up roll 58 with the toner powder image contacting fuser roll 56. In this manner, the toner powder image is permanently affixed to sheet 40. After fusing, chute 60 guides the advancing sheet to catch tray 62 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Preferably, cleaning station F includes a pre-clean corona generating device (not shown) and a rotatably mounted fibrous brush 64 in contact with photoconductive surface 12. The pre-clean corona generating device neutralizes the charge attracting the particles to photoconductive surface 12. These particles are then cleaned from photoconductive surface 12 by the rotation of brush 64 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of the illustrative electrophotographic printing machine incorporating the features of the present invention therein.

Figure 2:
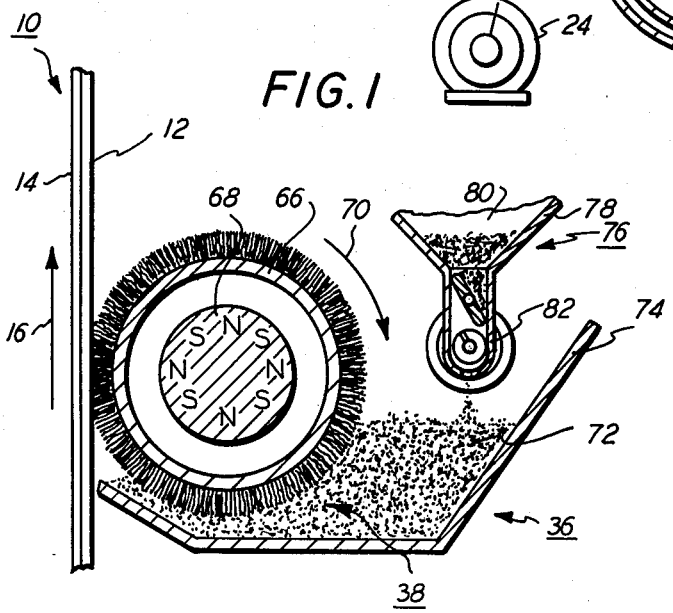
FIG. 2 is a schematic elevational view depicting the development system of the FIG. 1 printing machine.

Referring now to FIG. 2, there is shown development system 36 in greater detail. As depicted thereat, development system 36 includes developer roller 38 comprising a non-magnetic tubular member 66. An elongated magnetic member 68 is positioned interiorally of tubular member 66 and spaced from the interior peripheral surface thereof. Tubular member 66 rotates in the direction of arrow 70 to advance developer material into contact with the electrostatic latent image recorded on photoconductive surface 12 of belt 10. As tubular member 66 rotates in the direction of arrow 70, it passes through the sump of chamber 72 in housing 74. Developer material, disposed in chamber 72, is attracted to tubular member 66 via the magnetic field generated by elongated magnetic member 68. In this manner, developer material is attracted to tubular member 66 and advances therewith into contact with the electrostatic latent image recorded on photoconductive surface 12 of belt 10. The electrostatic latent image attracts the toner particles from the developer material. Thus, toner particles are being continually depleted from the developer material. If additional toner particles were not furnished to the developer material, eventually the copies would become progressively lighter and degradate in quality. To this end, a toner particle dispenser, indicated generally by the reference numeral 76, furnishes additional toner particles to chamber 72 of housing 74. Toner particle dispenser 76 includes a container 78 storing a supply of toner particles in chamber 80 thereof. The lower end portion of chamber 80 has an aperture with the entrance port of auger 82 being disposed thereat. Auger 82 includes an enclosure having a plurality of apertures therein coupled to a trough having a helical member positioned therein. Toner particles are dispensed from the apertures in the enclosure to a position in chamber 72 immediately beneath container 78. Furthermore, toner particles are dispensed over the sloping edge of the trough into chamber 72 at a position displaced from container 78. The detailed structure of toner dispenser 76 will be described hereinafter with reference to FIG. 3.

By way of example, elongated magnetic member 68 is cylindrical and preferably made from barium ferrite having a plurality of magnetic poles impressed about the circumferential thereof. Tubular member 66 is made preferably from aluminum having the exterior circumferential surface thereof roughened.

Figure 3:
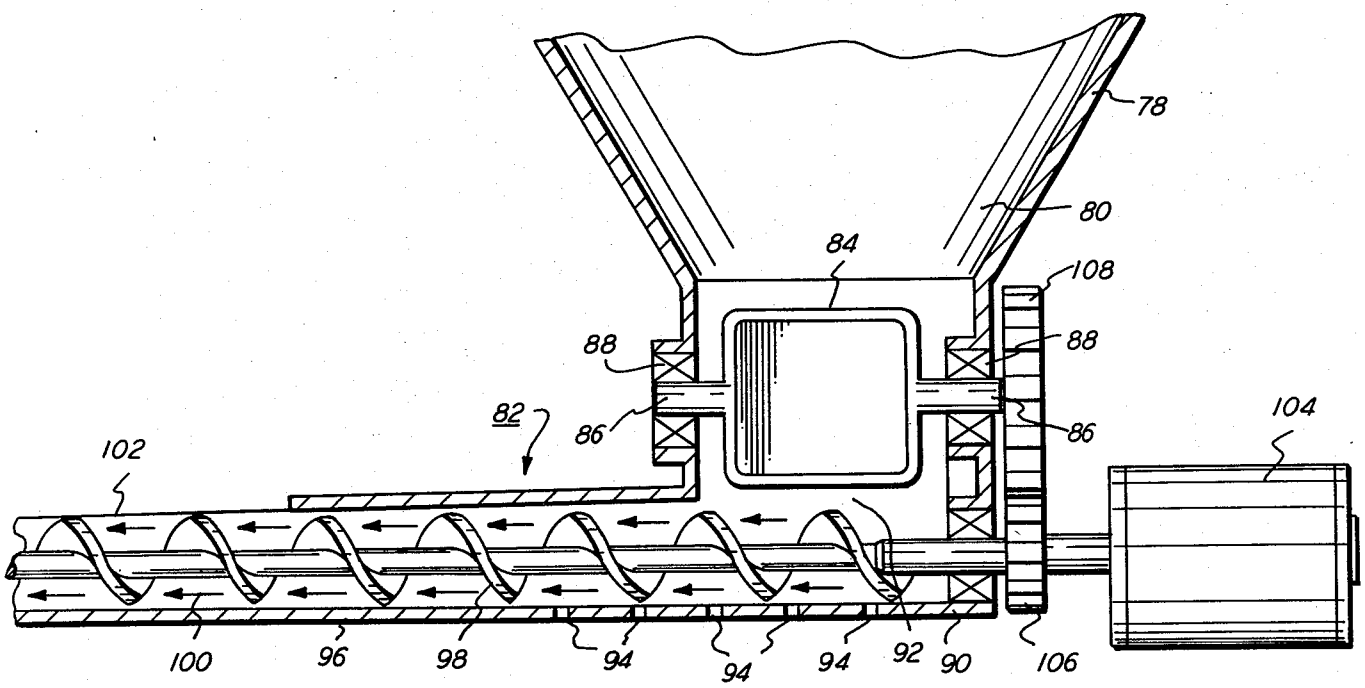
FIG. 3 is a fragmentary, side elevational view of the particle discharging apparatus used in the FIG. 2 development system.

Referring now to FIG. 3, the toner particles in chamber 80 of hopper 78 are agitated by a rectangular frame 84 having shafts 86 extending outwardly therefrom. Shafts 86 are supported in bearings 88 mounted in the lower portion of container 78. Enclosure 90 has an entrance port 92 in communication with chamber 80 of container 78 so as to receive toner particles being discharged from chamber 80. Toner particles are dispensed through apertures 94. Apertures 94 are a plurality of substantially equally spaced holes in enclosure 90 so as to uniformly dispense toner particles to the developer material in chamber 72 of housing 74 located immediately below container 78. Trough 96 is in communication with the exit port of enclosure 90. Helical member 98 is disposed interiorly of trough 96. As helical member 98 rotates, toner particles are advanced in the direction of arrow 100. Toner particles are advanced by the helical member 98 along trough 96 so as to be discharged over downward sloping edge 102 of trough 96. Inasmuch as trough 96 extends across chamber 72 of housing 74, toner particles are dispensed substantially uniformly over sloping edge 102 at a location displaced from container 78. The slope of edge 102 of trough 96 is shaped to provide for substantially uniformly dispensing of toner particles along the length thereof. Motor 104 is coupled to helical member 98. Actuation of motor 104 causes helical member 98 to rotate. Gear 106 is also mounted on helical member 98 and rotates therewith. Gear 106 meshes with gear 108. Gear 108 is mounted on shaft 86. As gears 106 and 108 rotate, both helical member 98 and rectangular frame 84 rotate to insure the uniform dispensing of toner particles into chamber 72 of housing 74.

In normal operation, motor 104 is continuously energized so as to dispense toner particles substantially uniformly along the length of chamber 72 of housing 74. The dispensing rate corresponds with the usage rate. However, actuation of motor 104 is initiated when the print button of the printing machine is depressed.

It is thus clear that the toner dispensing system of the present invention discharges toner particles in the region immediately beneath the container storing a supply of toner particles as well as in a region displaced therefrom. This insures that a uniform supply of toner particles is dispensed along the chamber storing the supply of developer material used to develop the electrostatic latent image recorded on the photoconductive surface.

In recapitulation, the apparatus of the present invention discharges toner particles in the region immediately beneath the toner particle storage container as well as in a region displaced therefrom to insure a substantially uniform flow of toner particles into the developer material facilitating the intermingling of toner particles and developer material. In this way, the developer material is always maintained at a substantially optimum toner particle concentration insuring high quality of copies.

It is, therefore, evident that there has been provided, in accordance with the present invention, an apparatus for dispensing toner particles which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for discharging particles into the chamber of a housing storing a supply of developer material therein, including:

means for storing a supply of particles therein;

an enclosure having an entrance port in communication with said storing means for receiving particles therefrom and a plurality of substantially equally spaced apertures therein for dispensing particles therefrom;

a trough having an entrance port coupled to said enclosure and a sloping, edge located remotely from the apertures in said enclosure, for discharging the received particles into the chamber of the housing;

a helical member mounted rotatably in said trough; and means for rotating said helical member relative to said trough to move the received particles therealong for discharge over the sloping edge thereof to the remaining developer material in the chamber of the housing.

2. An apparatus according to claim 1, further including means, operatively associated with said storing means, for agitating the particles therein to facilitate dispensing therefrom.

3. An apparatus according to claim 2, wherein said storing means includes a container having an open-ended chamber in communication with said enclosure.

4. An apparatus for developing an electrostatic latent image recorded on a photoconductive member used in an electrophotographic printing machine, including:

a housing storing a supply of developer material comprising carrier granules and toner particles in the chamber thereof;

means for advancing the developer material into contact with the electrostatic latent image so that a portion of the toner particles are attracted from the carrier granules to the electrostatic latent image forming a toner powder image on the photoconductive member;

means for storing a supply of toner particles therein;

an enclosure having an entrance port in communication with said storing means for receiving toner particles therefrom and a plurality of substantially equally spaced apertures therein for dispensing toner particles therefrom;

a trough having an entrance port coupled to said enclosure and a sloping, edge located remotely from the apertures in said enclosure, for discharging the received toner particles into the chamber of said housing;

a helical member mounted rotatably in said trough; and means for rotating said helical member relative to said trough to move the received toner particles therealong for discharge over the sloping edge thereof to the remaining developer material in the chamber of said housing.

5. An apparatus according to claim 4, further including means, operatively associated with said storing means, for agitating the toner particles therein to facilitate dispensing therefrom.

6. An apparatus according to claim 5, wherein said storing means includes a container having an open-ended chamber in communication with said enclosure.

* * * * *